US005893356A

United States Patent [19]

Johns

[11] Patent Number: 5,893,356

[45] Date of Patent: Apr. 13, 1999

[54] BOW SIGHT SUPPORT

[76] Inventor: Michael T. Johns, 880 Mayflower, Buchanan, Mich. 49107

[21] Appl. No.: 08/856,512

[22] Filed: May 15, 1997

[51] Int. Cl.[6] ..... F41G 1/467

[52] U.S. Cl. ..... 124/87; 33/265

[58] Field of Search ..... 124/87; 33/265

[56] References Cited

U.S. PATENT DOCUMENTS

| | | | |
|---|---|---|---|
| 2,982,026 | 5/1961 | Peterson | 33/265 |
| 3,013,336 | 12/1961 | Pennington | 33/265 |
| 3,271,863 | 9/1966 | Harrington | 33/265 |
| 4,142,297 | 3/1979 | Altier | 33/265 |
| 5,092,053 | 3/1992 | Roberts | 33/265 |
| 5,117,804 | 6/1992 | Jorlov | 124/87 |
| 5,341,791 | 8/1994 | Shafer | 124/87 |
| 5,495,675 | 3/1996 | Huang | 33/265 X |
| 5,524,351 | 6/1996 | Pinson et al. | 33/265 |

*Primary Examiner*—John A. Ricci
*Attorney, Agent, or Firm*—Baker & Daniels

[57] ABSTRACT

A bow sight support for mounting to a bow riser including a mount for attachment to the bow riser and a movable part adjustably connected to the mount for positioning the bow sight along an arcuate path defined by the archer's draw radius. The movable part includes a pair of curved channels which slide along a corresponding pair of curved rails of the mount when an adjustment mechanism connected to the movable part is actuated. The mount is adjustable when secured to the riser to permit adjustments in the arcuate adjustment path of the sight to correspond with different draw radii. A pair of support arms are adjustably attached to the movable part to provide horizontal angular adjustment of the sight.

11 Claims, 9 Drawing Sheets

10

180
40
14
152
156
130
10
24
12
136
62
100
82
34
44
63
154
46
64
102
43
65
32
42
28
38
30
36

BOW SIGHT SUPPORT

The present invention relates to a bow sight support adapted for attachment to a bow riser for adjustably supporting an aiming sight within the archer's line of sight to a target.

BACKGROUND OF THE INVENTION

The level of shooting accuracy desired by bow hunters and competition archers exceeds that readily achievable without the use of a sighting device such a simple pin sight or an optical sight capable of magnification. Such sighting devices are typically used in conjunction with a support bracket attached to the bow riser to precisely position the sight between the archer's eye and the target. Conventional bow sight supports are deficient because they are not sufficiently adjustable to maintain the sight within the archer's line of sight to the target as the archer raises or lowers the bow relative to horizontal, depending upon the distance to the target, to provide an arrow trajectory which terminates at the target. Instead, conventional sight supports are typically fixed to the bow riser and provide a pivotal adjustment of the sight so that when the bow is raised, for example, to provide the arrow trajectory required for a distant target, the sight may be tilted downwardly relative to horizontal toward the target. This sight positioning requires an adjustment in the position of the archer's eye relative to the position of the anchor point of the string when fully drawn (i.e., an adjustment in peep height) so that the archer's line of sight to the target passes through the bow sight to thereby realize the aiming benefits of the sight. Since accurate shooting requires a repeatable draw and shooting stance, any adjustments in peep height are considered undesirable.

Other conventional sight supports provide arcuate adjustment of the sight along a path curved or bowed outwardly from the archer's eye to minimize the peep height adjustment required for a particular target. Nonetheless, since this arcuate adjustment path does not precisely correspond to the arc along which the bow is positioned to provide the desired arrow trajectory, some peep height adjustment is still required. Furthermore, the amount of peep height adjustment mounting depends upon the particular archer's draw length (i.e., the approximate distance between the archer's grip on the riser and the archer's anchor point). An archer with a long draw length positions the bow riser for various arrow trajectories along an arc which is more gradual than the aiming arc of an archer with a short draw length. Since the arcuate adjustment path of conventional supports is not adjustable to correspond to bow adjustment paths, the more the archer's bow adjustment path differs from the arcuate path provided by such sight supports, the greater the required peep height adjustment.

Also, conventional sight supports require the use of shims to compensate for the twisting or cantering of the bow riser which occurs under full draw conditions (i.e., when the bow string is drawn). Since the sight support is mounted to the riser, as the riser canters about its vertical axis, the sight also rotates. Thus, the sight must be positioned in a skewed orientation relative to the line of sight to the target under relaxed conditions (i.e., when the string is not drawn) so that it will rotate into alignment with the line of sight under full drawn conditions. Heretofore, shims have been wedged between the riser and the sight support to position the support at an angle to compensate for the riser canter. Such shims vibrate loose and are easy to lose and difficult to install. Additionally, since the degree of canter depends upon the flexibility of the riser and bow limbs, the action of the cams, and the characteristics of the string system, the cumbersome process of shim adjustment must be repeated for each variation in bow setup.

SUMMARY OF THE INVENTION

The present invention provides a bow sight support for attachment to a bow riser which is adjustable along an arcuate path corresponding to the archer's draw length to maintain the bow sight within the archer's line of sight to the target when the bow is positioned to provide various arrow trajectories for targets located various distances from the bow. The sight support includes a mount which is secured to the riser and a movable part which is adjustably connected to the mount. The mount includes a guide which arcs or bows away from the archer to define an arcuate sight adjustment path substantially corresponding to the bow adjustment path resulting from an average draw length. The mount also includes slotted mounting apertures for adjusting the arcuate sight adjustment path to precisely correspond to a particular archer's bow adjustment path. The movable part includes a drive mechanism which engages the mount to move the movable part along the mount guide. The movable part carries an indicator pointer which cooperates with a distance gauge attached to the mount to indicate the distance at which the sight should be accurate. A pair of independently adjustable arms are connected to the movable part to support the sight on the arrow side of the riser in an orientation relative to the movable part to compensate for riser canter.

Accordingly, it is an object of the present invention to provide a bow sight support which adjustably positions the sight along an arcuate path corresponding to the bow adjustment path resulting from the archer's draw length thereby substantially eliminating peep height adjustments regardless of the distance to the target.

Another object of the invention is to provide a bow sight support which is adjustable to compensate for riser canter.

Yet another object of the invention is to provide a bow sight support which is easily adjustable to compensate for bow riser canter.

BRIEF DESCRIPTION OF THE DRAWINGS

These and other objects and advantages of the present invention, and the manner of attaining them, will become more apparent and the invention will be better understood upon reading the following description in conjunction with the drawings wherein.

DESCRIPTION OF THE INVENTION

The embodiments disclosed in the detailed description below are not intended to be exhaustive or to limit the invention to the precise forms disclosed. Rather, the embodiments selected for the description are disclosed so that others skilled in the art may utilize their teachings.

Figure 1:
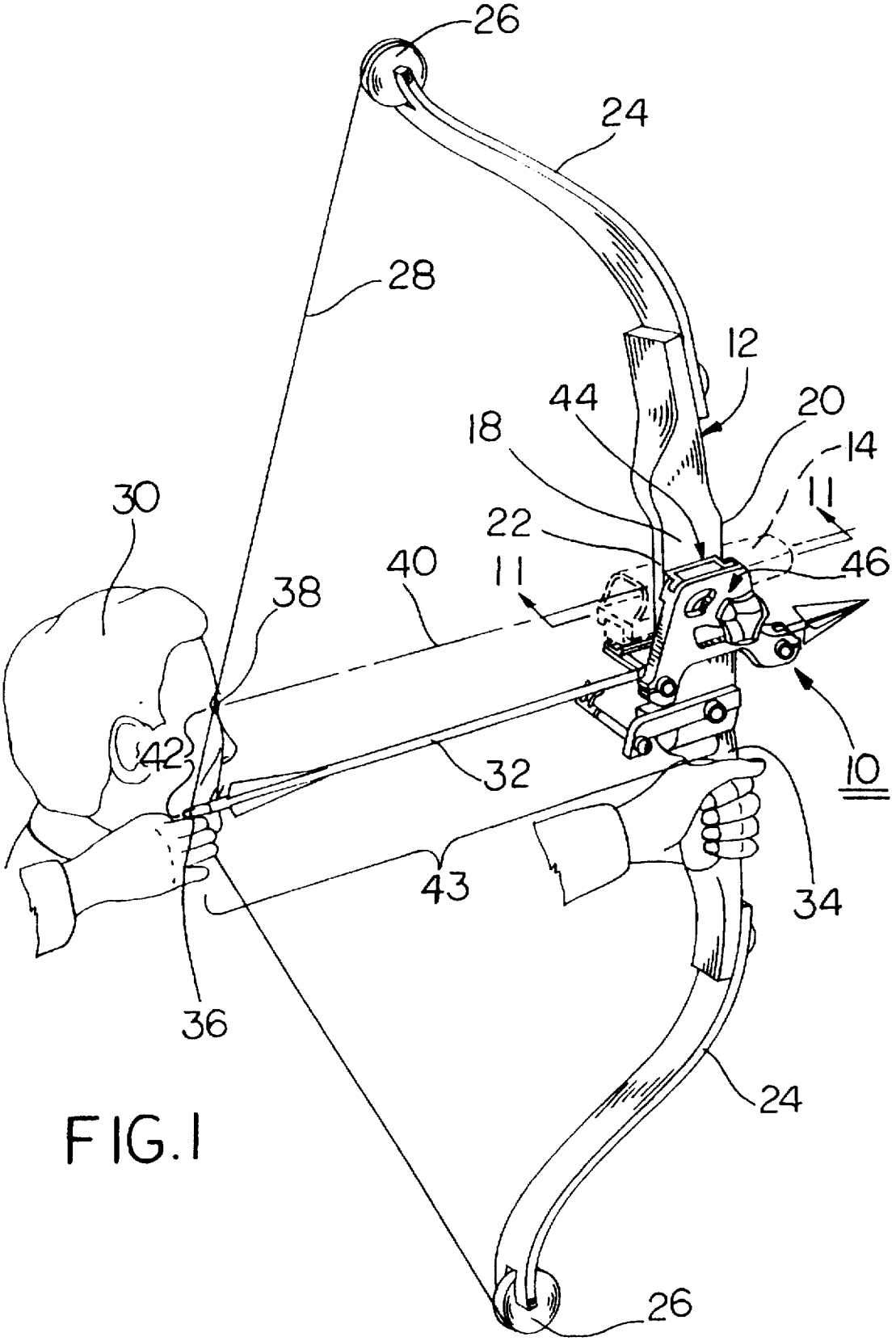
FIG. 1 is a perspective view of a bow sight support according to the present invention shown mounted to a compound bow in a fully drawn position and supporting an aiming sight shown in broken lines for illustrative purposes.

FIG. 1 shows the present bow sight support 10 mounted to a bow riser 12 and supporting an optical sight 14 (shown in broken lines). Riser 12 includes an arrow side 16, an opposite outer side 18, a front edge 20, and a rear edge 22. Attached to either end of riser 12 are bow limbs 24 which carry cams 26. A bow string 28 is strung between cams 26 in the standard manner (not illustrated in detail). The archer 30 shoots arrow 32 toward the target by gripping riser grip 34, pulling string 28 rearwardly to an anchor point 36, and adjusting the position of riser 12 until sight 14 is directly between the archer's eye 38 and the target (not shown), in the archer's line of sight 40 (indicated by broken lines). When in this shooting stance, the distance between anchor point 36 and the archer's eye 38 is commonly referred to as the peep height 42. The distance between grip 34 and anchor point 36 is commonly referred to as the draw length 43. The archer provides various arrow trajectories by raising and lowering the bow along a bow adjustment path defined by the arc about anchor point 36 having a radius equal to draw length 43. When string 28 is released, a properly aimed arrow 32 follows a trajectory which terminates at the target in the standard manner.

Figure 2:
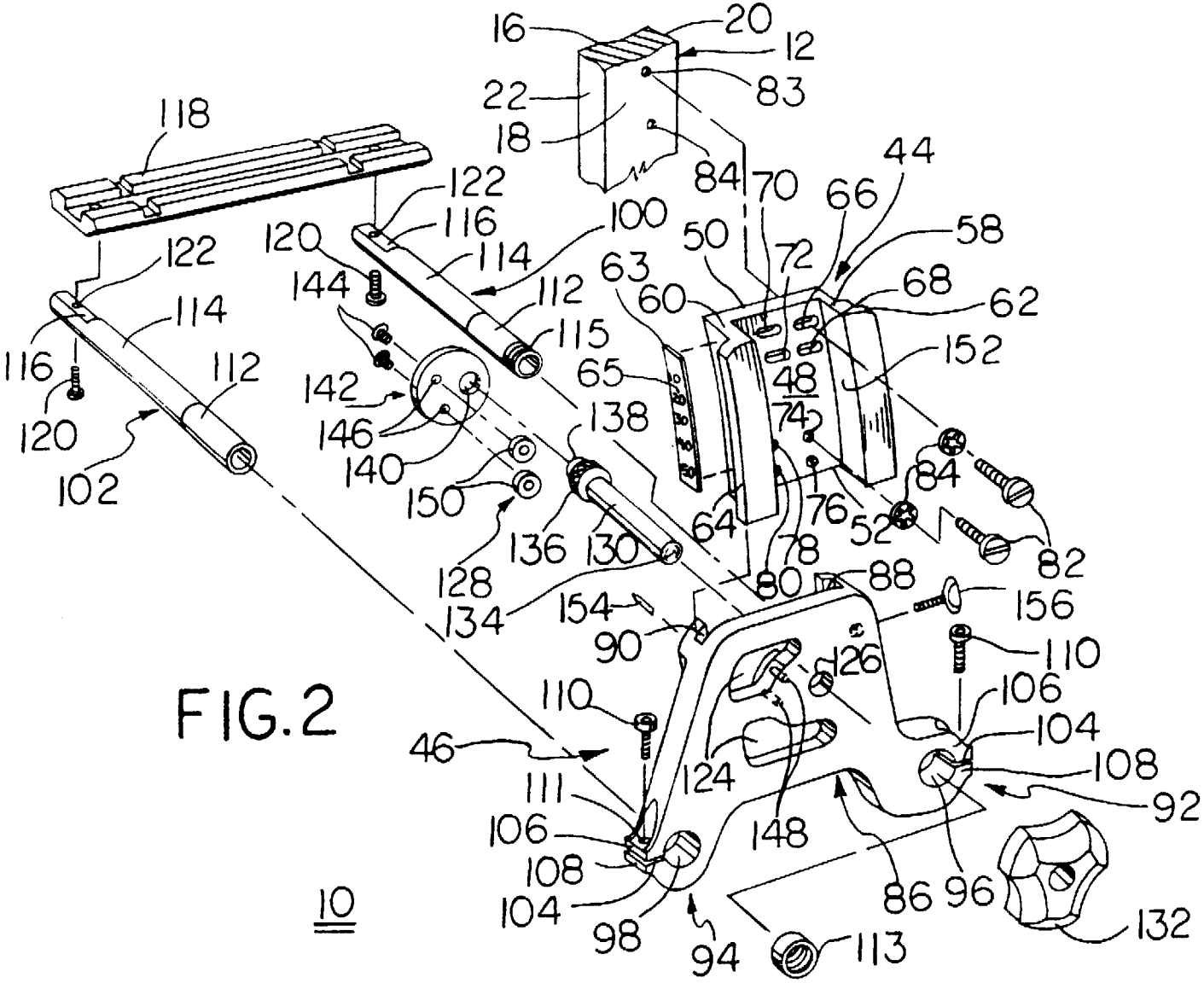
FIG. 2 is an exploded perspective view of the bow sight support of FIG. 1.
Figure 3:
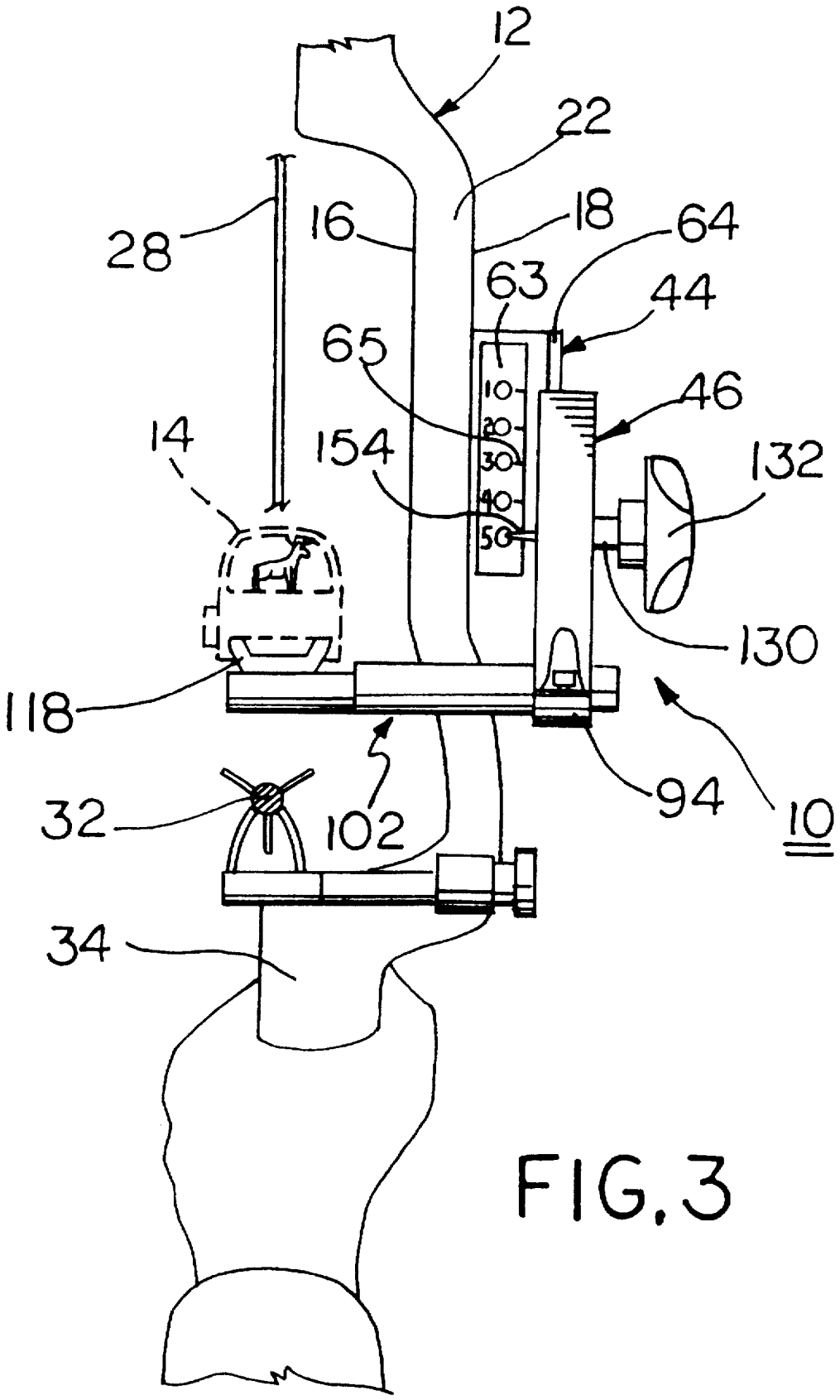
FIG. 3 is a fragmented rear elevational view, partly in section, of the bow sight support of FIG. 1.

Referring now to FIGS. 2 and 3, sight support 10 includes a mount 44 and a movable part 46. Mount 44 includes a mounting wall 48 with a top end 50, a bottom end 52, a forward side wall 58, and a rearward side wall 60. Side walls 58, 60 are equally spaced from one another and curve along an arc which extends forwardly from top end 50 to bottom end 52 of mounting wall 48. A guide rail 62 extends forwardly along the length of side wall 58. Another guide rail 64 extends rearwardly along the length of side wall 60. Together, guide rails 62, 64 define an arcuate adjustment path which substantially corresponds to the bow adjustment path of an archer having a predetermined draw length 43.

Mounting wall 48 further includes four mounting slots disposed adjacent top end 50 (upper forward slot 66, lower forward slot 68, upper rearward slot 70, and lower rearward slot 72) and four corresponding mounting holes disposed adjacent bottom end 52 (upper forward hole 74, lower forward hole 76, upper rearward hole 78, and lower rearward hole 80). Threaded fasteners 82 are inserted through washers 84 and selected pairs of mounting slots and mounting holes into a pair of vertically aligned, threaded attachment holes 83, 84 extending into outer side 18 of riser 12, thereby attaching mount 44 to riser 12.

As best shown in FIG. 3, a distance gauge 63 having yardage marks 65 is attached to rearward side wall 60 of mount 44 for use in the adjustment of sight support 10. Gauge 63 may be attached using adhesive, screws, or any other appropriate means which permits removal and reuse of the gauge and attachment of other similar gauges for different bow setups.

Movable part 46 includes a frame 86 having a pair of spaced, opposed arcuate channels (forward channel 88 and rearward channel 90). Movable part 46 is positioned onto mount 44 by sliding channels 88, 90 of the part over rails 62, 64 of the mount. Frame 86 also includes a pair of outset clamping ears 92, 94 each defining a cylindrical, slotted opening 96, 98 for slidably receiving a sight support arm 100, 102. A lock screw 110 is threaded into each ear 92, 94 across the slot 104 therein, which when tightened, causes the ear to clamp the inserted support arm.

Each support arm 100, 102 includes an inner end section 112 and an outer end section 114 which includes a flat 116. The inner end section 112 of arm 100 is threaded. A knob 113 is threaded onto the exposed portion of the threaded end of section 112 of support arm 100 after the support arm is inserted through opening 96. A standard sight base 118 is supported between arms 100, 102 on flats 116. Sight base 118 is used to support a scope optical sight 14 as shown in FIG. 1. As should be apparent, a two-piece sight base could also be used to accommodate different sight configurations, and base 118 could be adapted to support certain types of pin sights. Sight base 118 is attached to arms 100, 102 at flats 116 with a pair of screws 120 which are inserted through bores 122 extending into flats 116 and threadably received by the threaded openings in sight base 118. Such an attachment method securely positions base 118 upon arms 100, 102 yet permits each arm to pivot slightly about screws 120 relative to the base when the arm is moved axially inwardly or outwardly relative to frame 86.

Figure 11:
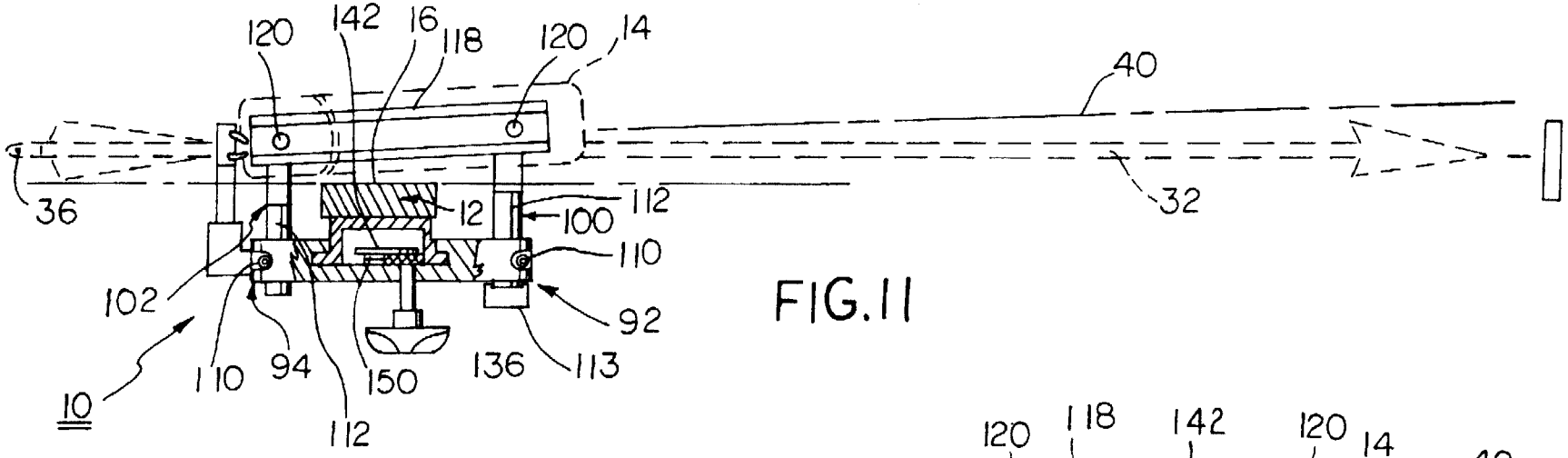
FIG. 11 is a cross-sectional view taken substantially along line 11—11 of FIG. 1 with the bow under relaxed conditions.
Figure 12:
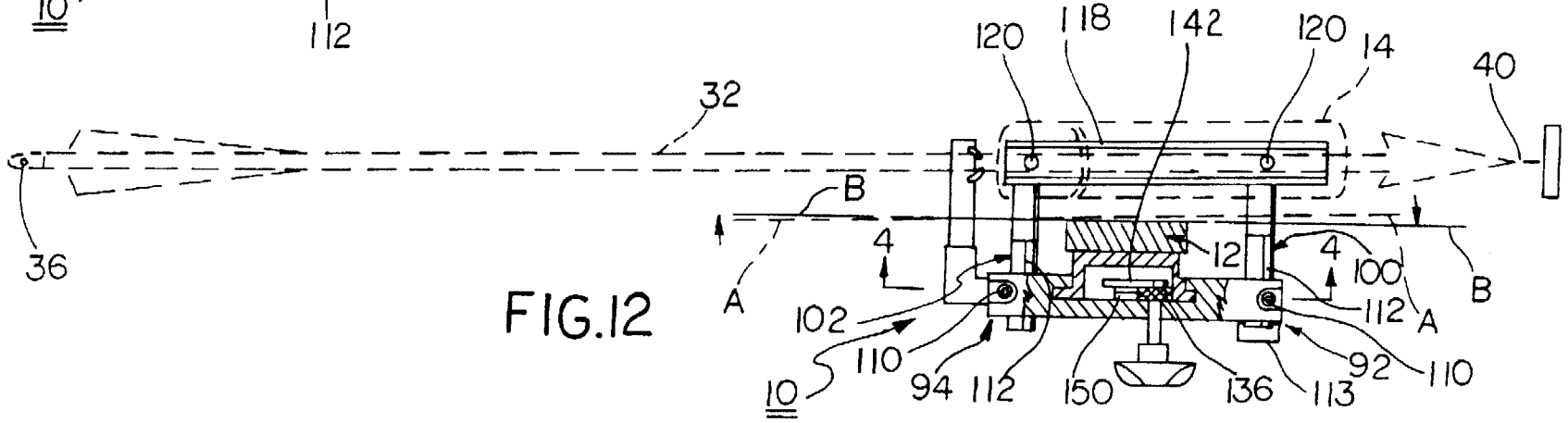
FIG. 12 is a view similar to FIG. 11 showing the bow under full draw conditions.

Frame 86 includes voids 124 for weight reduction and access to mounting slots 66, 68, 70, 72 and mounting holes 74, 76, 78, 80, and an aperture 126 for supportably receiving a drive mechanism generally designated 128. Drive mechanism 128 includes a rod 130 which extends through aperture 126. Rod 130 carries an adjustment knob 132 on one end 134 at the outer side of movable part 46 and a knurled, cylindrical drive part 136 adjacent the other end 138. End 138 is journaled in an opening 140 in a support part 142. Support part 142 is secured to frame 86 using fasteners 144 which extend through apertures 146 in the part, spacers 150, and into threaded bores 148 extending into frame 86. As best shown in FIGS. 11 and 12, spacers 150 have a thickness slightly exceeding the thickness of drive part 136 so as to allow drive part 136 to rotate between support part 142 and movable part 46 when rod 130 is rotated by tuning knob 132. Drive part 136 contacts the inner surface 152 of forward side wall 58 of mount 44.

As should be apparent, a sprocket could readily replace drive part 136 whereupon inner surface 152 would carry teeth corresponding to the sprocket. Furthermore, alignment part 142 could readily be formed to a thickness and shape which would eliminate the need for washers 150.

An indicator point 154 is secured to movable part frame 86 so that with movable part 46 positioned onto rails 62, 64 of mount 44, indicator point 154 overlies distance gauge 63. As movable part 46 is adjusted along rails 62, 64 using drive mechanism 128, indicator point 154 is carried along distance gauge 63 to align with yardage marks 65. A set screw 156 extends through frame 86 to engage rail 62 and lock movable part 46 into position relative to mount 44.

Mode of Operation

Figures 4, 5:
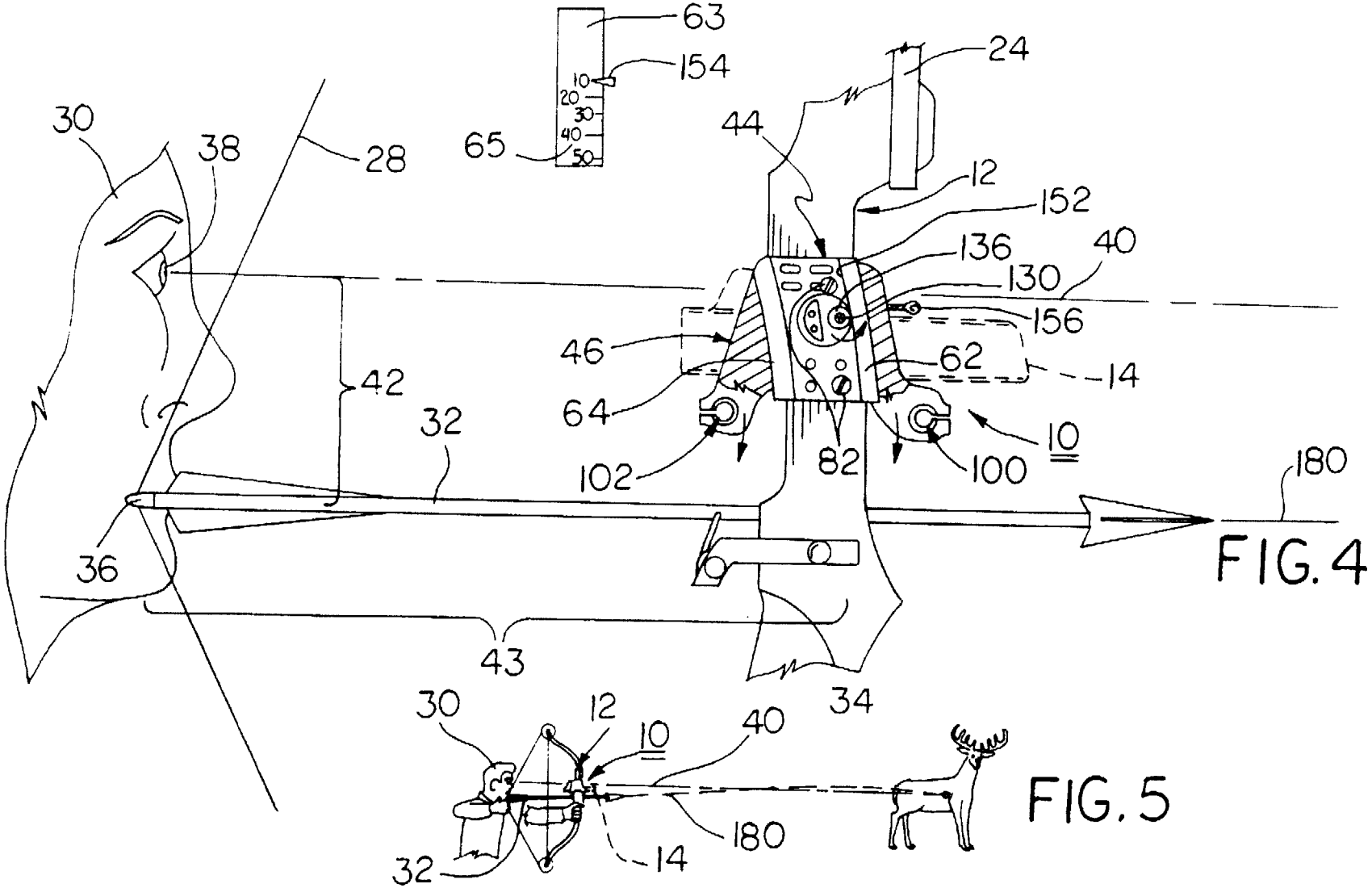
FIGS. 4 and 5 are fragmented side elevational views, partly in section, illustrating the present invention adjusted to maintain the sight within the archer's line of sight to a nearby target.

FIGS. 4 through 7 illustrate an adjustment of bow sight support 10 to maintain sight 14 within line of sight 40 when archer 30 changes the position of riser 12 from a first, nearly upright position (FIGS. 4 and 5) providing an arrow trajectory 180 terminating at a target ten yards from the bow, to a second, more tilted position (FIGS. 6 and 7) providing an arrow trajectory 182 terminating at a target fifty yards from the bow. After determining or estimating that the target in FIGS. 4 and 5 is approximately ten yards from the bow, archer 30 adjusts sight support 10 by turning adjustment knob 132. The rotation of knob 132 rotates drive part 136 which is in driving contact with inner surface 152 of forward side wall 58. This coaction between drive part 136 and inner surface 152 causes movable part 46 at channels 88, 90 of movable part 46 to slide along rails 62, 64 of mount 44. Movable part 46 thereby moves along the arcuate adjustment path defined by rails 62, 64 relative to mount 44 until indicator point 154 is brought into alignment with the ten yard mark on distance gauge 63 as shown in the inset of FIG. 4. Set screw 156 is tightened into engagement with mount 44 to secure movable part 46 in a fixed position relative to mount 44. Archer 30 then grasps riser grip 34 and positions the bow so that the target is visible through sight 14. As best shown in FIG. 5, when sight 14 is brought into line of sight 40, riser 12 is tilted to direct arrow 32 slightly upwardly relative to horizontal to follow trajectory 180 which converges with line of sight 40 at the desired target location.

Archer 30 must initially calibrate the yardage marks 65 on distance gauge 63. Yardage marks 65 directly correspond to selected arrow trajectories which terminate at selected distances. As is well known in the art, an arrow trajectory is affected by a variety of factors, including limb 24, cam 26, string 28, and arrow 32 selection. Thus, a unique distance gauge 63 should be created for each setup commonly used by the archer. Since the distance gauges 63 are removably attached to mount 44, after a set of calibrated gauges are created, an appropriate gauge may be selected, affixed to mount 44 for shooting, removed when the archer changes his setup, and stored for future use.

Figure 6:
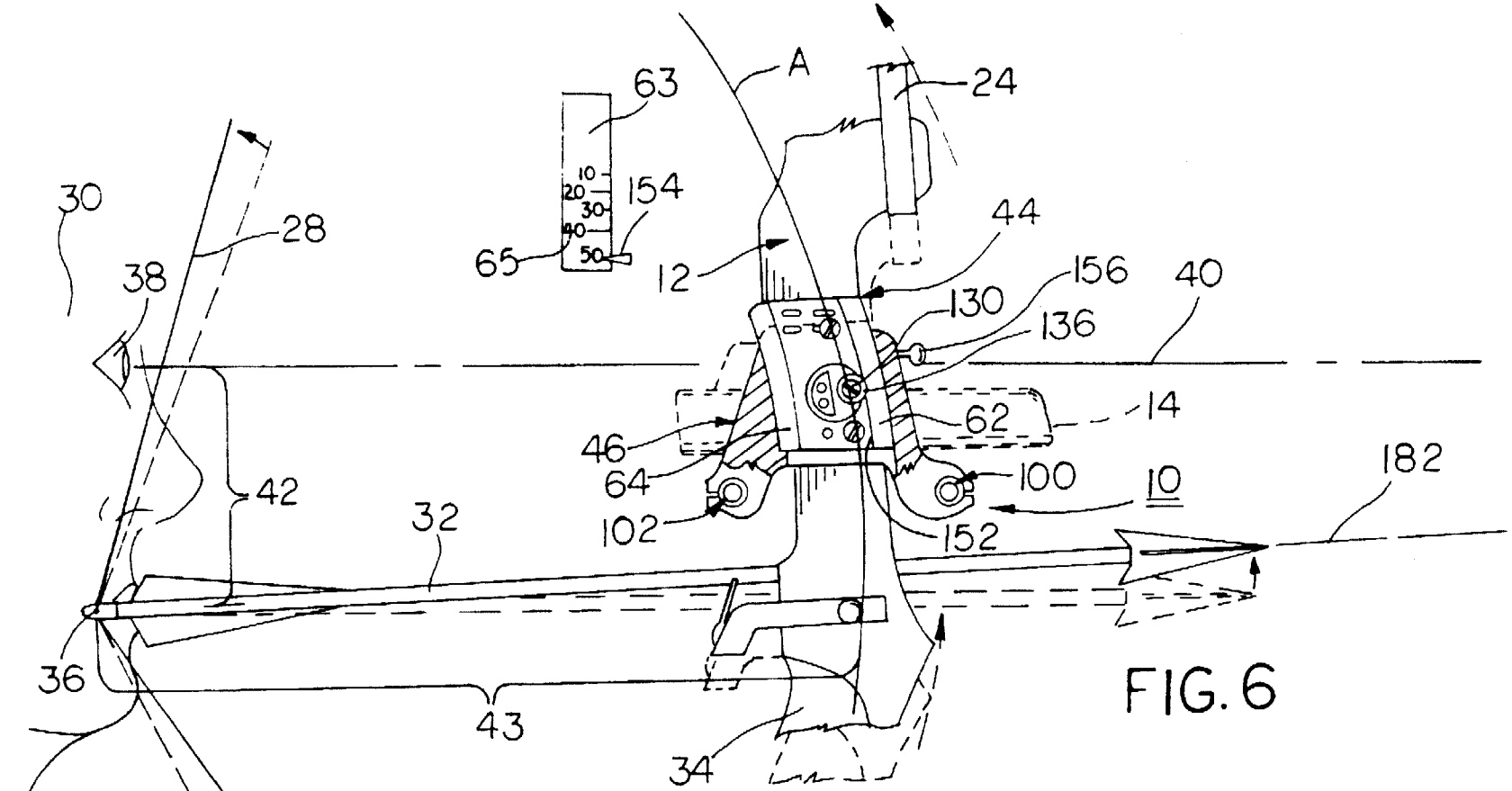
FIGS. 6 and 7 are views similar to FIGS. 4 and 5 illustrating the present invention adjusted to maintain the sight within the archer's line of sight to a distant target.
Figure 7:
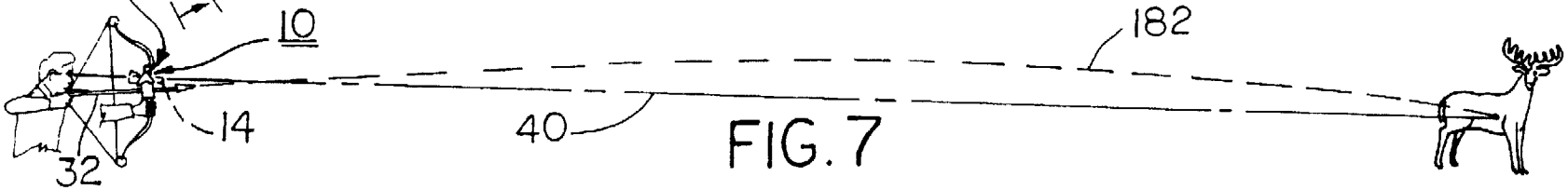

FIGS. 6 and 7 show sight support 10 adjusted for a target fifty yards from the bow. Set screw 156 is first loosened to permit adjustment of movable part 46. As indicated by the arrows in FIG. 4, movable part 46 is adjusted downwardly relative to mount 44 along the arcuate adjustment path defined by mount rails 62, 64 by rotating rod 130 counter-clockwise using adjustment knob 132 with drive part 136 traveling along mount inner surface 152. Movable part 46 is thereby guided downwardly by channels 88, 90 and rails 62, 64 until indicator 154 is aligned with the fifty yard mark on distance gauge 63 as shown in the inset of FIG. 6. Set screw 156 is then tightened to secure movable part 46. When archer 30 positions the bow so that the new, more distant target is visible through sight 14, riser 12 is raised and tilted to direct arrow 32 upwardly relative to horizontal to follow trajectory 182 which converges with line of sight 40 at the desired target location.

As archer 30 raises riser 12 to provide arrow trajectory 182, the entire bow assembly pivots counter-clockwise about anchor point 36 along semi-circular bow adjustment path "A" from the position of FIG. 4 (shown in dotted lines in FIG. 6) to the position corresponding to a fifty yard arrow trajectory (shown in solid lines in FIG. 6). Similarly, during the above described adjustment of movable part 46, rails 62, 64 guide the movable part (and sight 14) along substantially the same path "A". Thus, the lowered clockwise adjustment of movable part 46 to the fifty yard position compensates for the counter-clockwise repositioning of the bow assembly to retain sight 14 in its original, horizontal position within line of sight 40. Accordingly, undesirable adjustments in peep height 42 are avoided.

Figure 8:
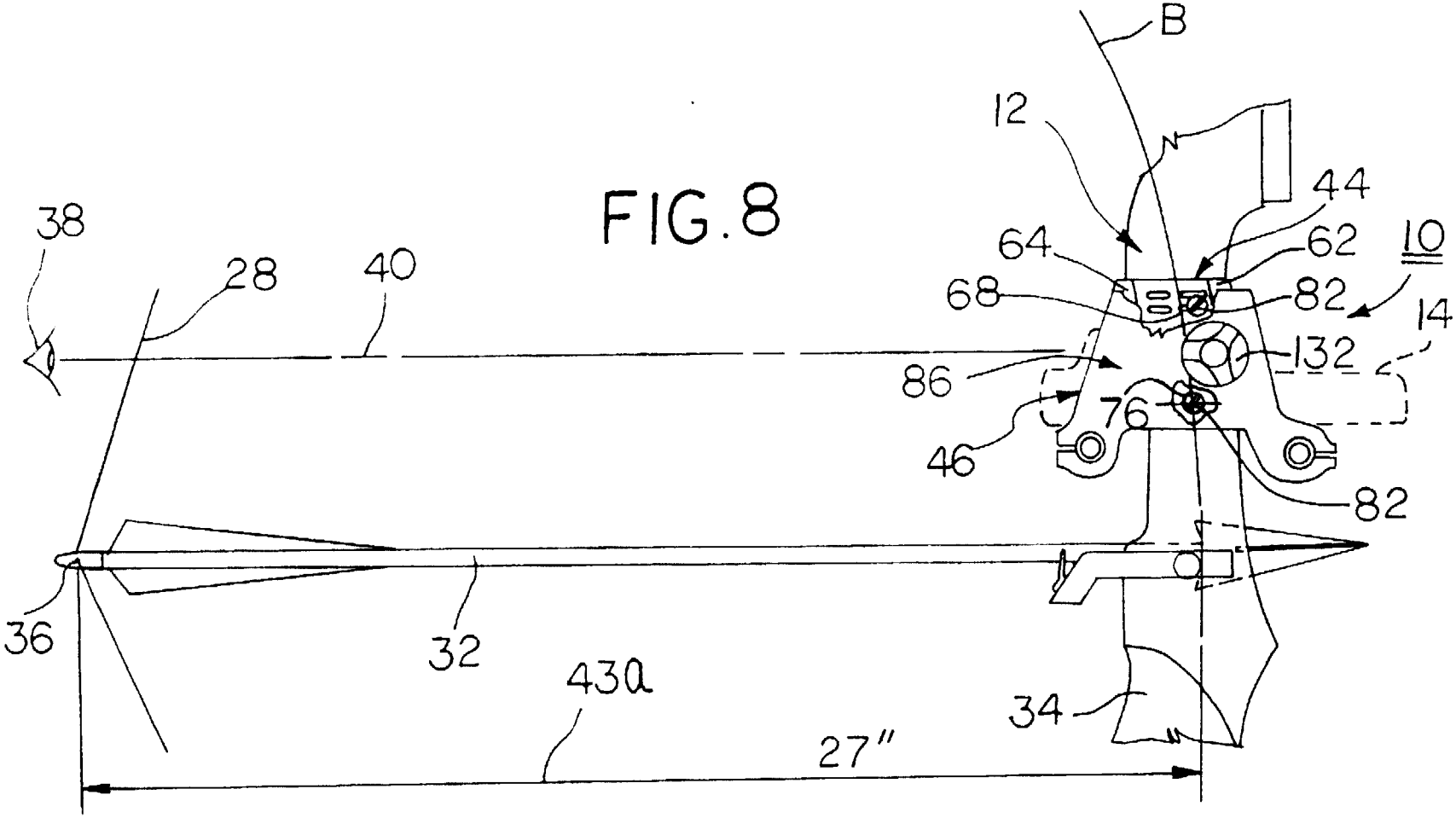
FIG. 8 is a fragmented side elevational view, partly in section, of the bow sight support of the present invention mounted to a bow drawn to a relatively short draw length.
Figure 9:
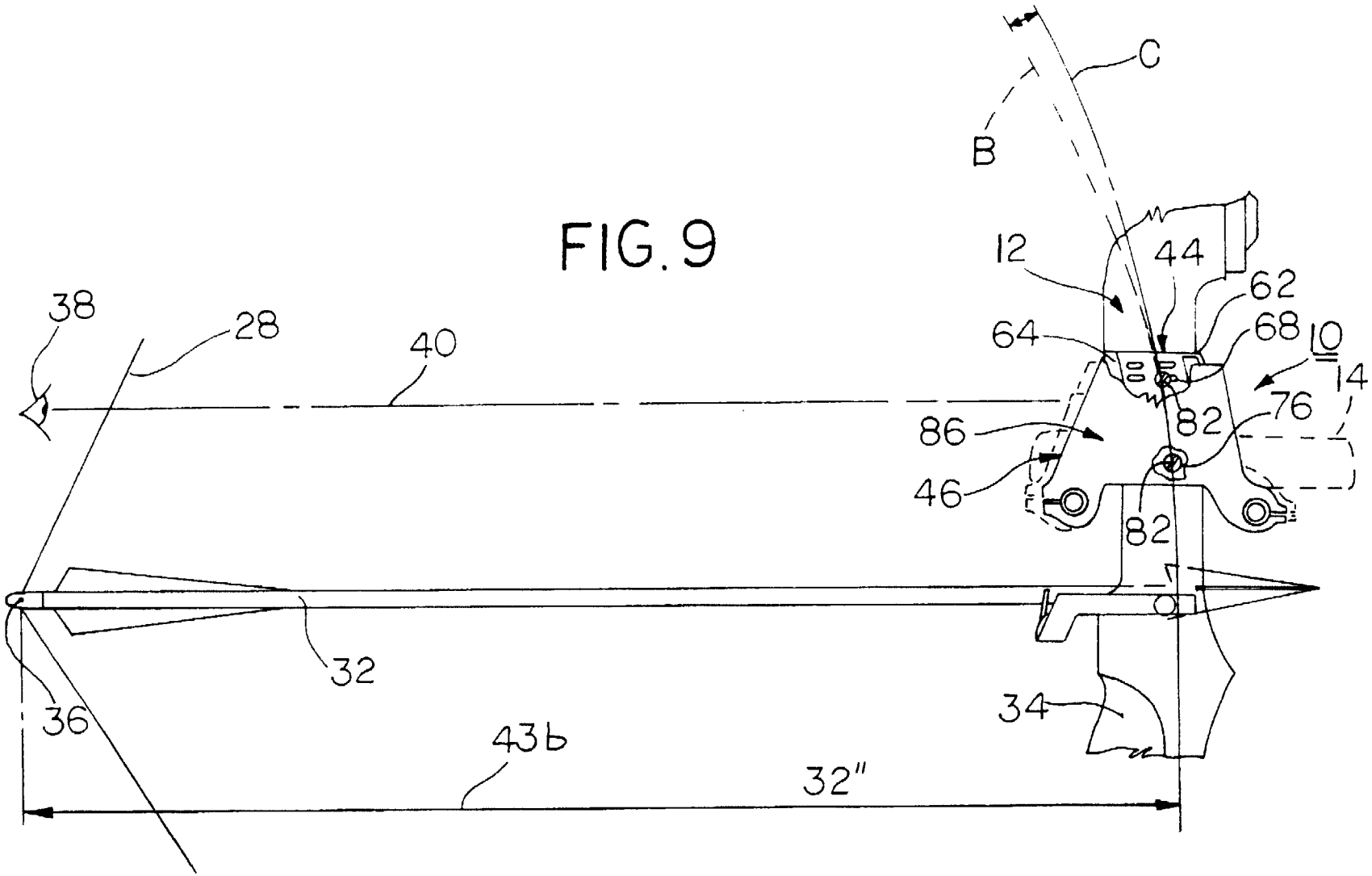
FIG. 9 is a view similar to FIG. 8 showing the bow sight support mounted to a bow drawn to a relatively long draw length.

FIGS. 8 and 9 illustrate the fine adjustment of the arcuate sight support adjustment path to precisely correspond to the bow adjustment path associated with different draw lengths 43. FIG. 8 shows a bow under full draw conditions having a draw length of twenty-seven inches designated 43*a*. Mount 44 is attached to riser 12 with one fastener 82 inserted through mounting hole 76 into riser attachment hole 84 and another fastener 82 inserted through mounting slot 68 into riser attachment hole 83. Mount 44 is pivoted rearwardly relative to riser 12 about mounting hole 76 so that the fastener 82 is positioned adjacent the forward portion of mounting slot 68. This orientation of mount 44 ensures that mount rails 62, 64 guide movable part 46 (and sight 14) along a sight support adjustment path which corresponds to the bow adjustment path "B" resulting from a relatively short draw length 43*a* (i.e., the general radius of rotation about anchor point 36) as will be better understood by reference to FIG. 9.

Figure 10:
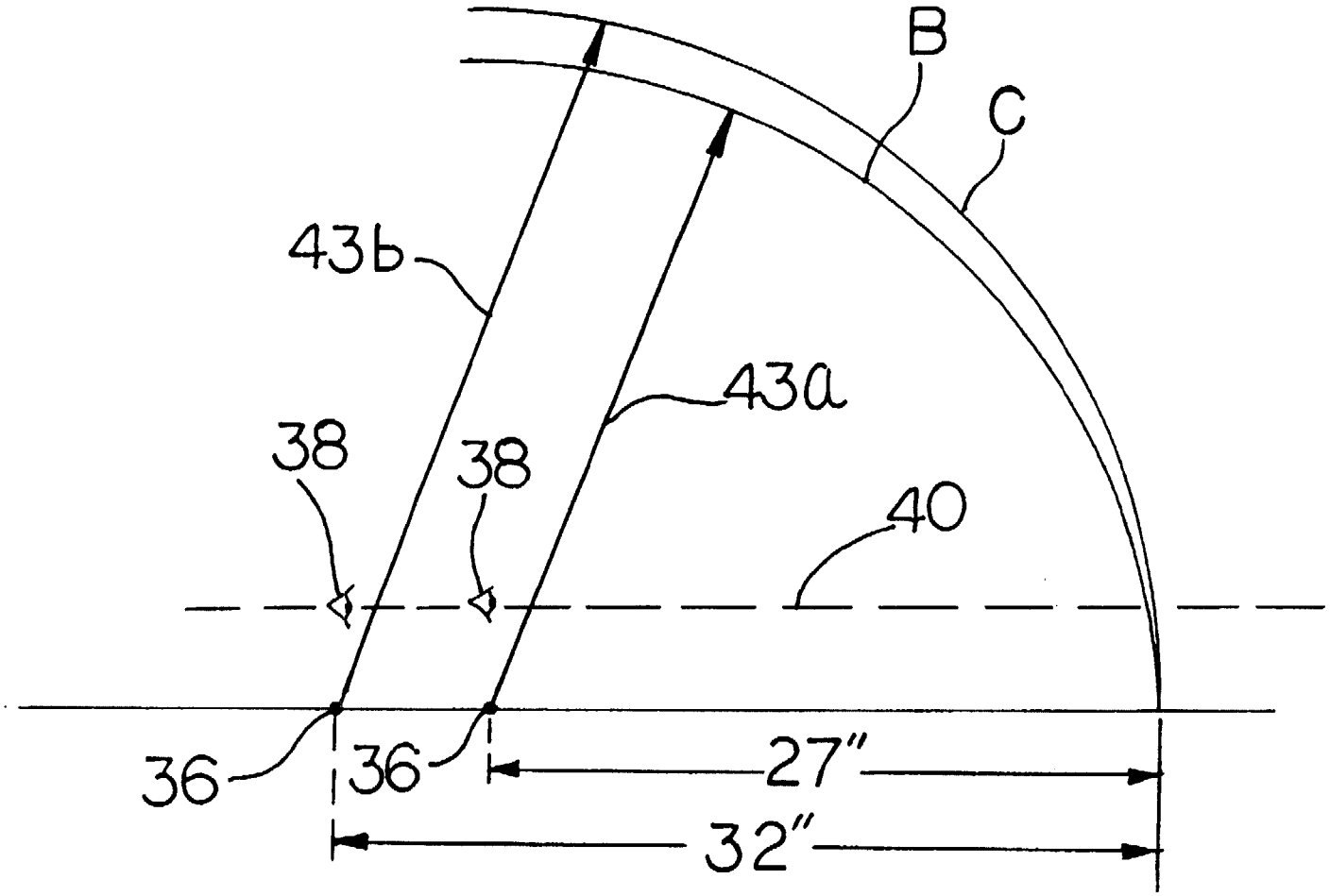
FIG. 10 is a conceptual view illustrating the relationship between draw length and the adjustment of the present invention.

FIG. 9 shows a bow under full draw conditions having a draw length of thirty-two inches designated 43*b*. Mount 44 has been pivoted forwardly relative to riser 12 about mounting hole 76 so that fastener 82 is positioned adjacent the rearward portion of mounting slot 68. In this configuration, as riser 12 is repositioned more upright and along path "C" to provide arrow trajectories corresponding to more distant targets, movable part 46 is likewise adjusted on rails 62, 64 along path "C" to maintain sight 14 within line of sight 40 as explained above. As shown in FIGS. 9 and 10, had mount 44 remained in the orientation of FIG. 8 (shown in dotted lines in FIG. 9), any adjustments of movable part 46 would have been along path "B" which, because of its smaller radius of rotation about anchor point 36, does not correspond to the bow adjustment path "C." As should be apparent, a range of adjustment is provided by mounting slot 68 to accommodate a range of draw lengths 43.

The four mounting slots 66, 68, 70, 72 in mount 44 and corresponding mounting holes 74, 76, 78, 80 in movable part 46 are provided to accommodate different peep heights 42 and different riser attachment hole locations. Some archers prefer a short peep height 42 and draw to an anchor point 36 near the eye 38, for example, adjacent the cheek. Others prefer a higher peep height 42 and draw to an anchor point 36 further below the eye, for example, adjacent the chin. Since riser attachment holes 83, 84 are uniformly spaced by riser manufacturers, mount 44 may be attached lower on riser 12, closer to arrow 32, by using slot 66 and hole 74 or slot 70 and hole 78 to provide a short peep height 42. Similarly, mount 44 may be further spaced from arrow 32 by using slot 68 and hole 76 or slot 72 and hole 80. Additionally, mount 44 may be attached using slot 68 and hole 76 or slot 66 and hole 74 on risers manufacture with attachment holes 83, 84 located adjacent forward side 20 of riser 12 and slot 72 and hole 80 or slot 70 and hole 78 may be used on risers manufactured with attachment holes 83, 84 more centrally located between forward side 20 and rearward side 22.

FIGS. 11 and 12 illustrate the lateral adjustment of sight support 10 provided by support arms 100, 102 to compensate for the twisting or cantering of riser 12 when under full draw conditions and provide windage or left and right point of impact adjustment. FIG. 11 shows sight support 10 mounted to riser 12 under relaxed conditions. As shown, forward support arm 100 is adjusted to extend farther from frame 86 than rearward support arm 102. The support arm adjustment is made by unscrewing lock screws 110 to release the compressive force of ears 92, 94. Knob 113 is backed off the threaded end of arm 100. Arm 100 (or both arms 100, 102) is then positioned inwardly or outwardly through opening 96 to the desired location with knob 113 abutting movable part 46. Sight base 118 pivots on screws 120. Lock screws 110 are then tightened to compress ears 92, 94, thereby securing arms 100, 102 in place again, and screws 120 are tightened to secure base 118 in place. When so positioned, sight 14 is skewed or supported at an angle relative to arrow side 16 of riser 12. Accordingly, when sight 14 is positioned as shown in FIG. 11 for example, line of sight 40 is left of the target.

When arrow 32 is drawn as shown in FIG. 12, riser 12 canters to the right under the force of the string tension from plane "A" (relaxed position shown in dotted lines) to plane "B" (full draw position shown in a solid line). This canter rotates sight support 10 so that sight 14 is positioned within line of sight 40 to the target. As should be apparent from the foregoing, the amount and direction of riser canter depends, among other things, upon the physical characteristics of riser 12, limbs 24, cams 26, and string 28. Once the amount of canter for a particular bow setup is determined, the archer 30 can easily adjust support arm 100, or both arms 100, 102 to compensate for the canter and bring sight 14 within line of sight 40 under full draw conditions.

Fine adjustments of the position of support arm 100 are accomplished with fine adjust knob 113. After support arms 100, 102 have been shifted within openings 96, 98 to the approximate desired position, archer 30 may shoot arrows 32 to test the alignment of sight 14. Then, after loosening the forward lock screw 110, archer 30 may rotate fine adjust knob 113 on threads 115 provided on adjustment section 112 of support arm 100 to move arm 100 slightly inwardly or outwardly to fully compensate for the riser canter and provide left and right point of impact adjustment.

While this invention has been described as having a preferred design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains or fall within the scope of the appended claims.

I claim:

1. Bow sight support comprising:

a mount attachable to a bow riser, said mount including an arcuate guide rail defining an arcuate path about the archer's anchor point corresponding to a predetermined draw length;

a movable part adapted to carry a bow sight, said movable part engaging said guide rail and being adjustably positionable along said path on said guide rail to maintain the sight when carried by said movable part with the archer's line of sight to a target; and a pair of parallel support arms connected to said movable part and a sight base carried by said arms for supporting the bow sight, said base having a first end pivotally attached to one end of one of said arms and a second end pivotally attached to one end of the other of said arms, one of said support arms being axially movable relative to said movable part to shift said sight base.

2. A support according to claim 1 wherein said mount includes another said guide rail spaced apart from said first mentioned guide rail, said movable part including a corresponding pair of spaced apart arcuate channels slidably movable on said guide rails along said arcuate path.

3. A support according to claim 2 wherein said mount has a substantially U-shaped cross-section including a mounting wall adapted for attachment to the riser and located between said guide rails.

4. A support according to claim 3 wherein said movable part includes adjustment means for coacting with said mount to position said movable part relative to said mount.

5. A support according to claim 4 wherein said adjustment means includes a rod supported for rotation by said movable part and having a drive part at one end in operable engagement with said mount and an adjustment knob at the other end, whereby rotation of said adjustment knob causes said drive part to rotatably coact with said mount to move said movable part relative to said mount along said guide rails.

6. A support according to claim 1 wherein said movable part has a pair of openings slidably receiving said support arms, and means for securing said support arms to said movable part at said openings.

7. A support according to claim 1 wherein said mount includes attachment means for adjustably securing said mount to the bow riser, said attachment means for further providing tilting adjustment of said mount forwardly or rearwardly of said archer relative to said riser.

8. A support according to claim 7 wherein said bow riser includes a pair of holes, said attachment means including mounting orifices alignable over said riser holes and a pair of fasteners for insertion through said mounting orifices to threadably engage the riser holes, one of said mounting orifices being slotted to provide said tilting adjustment.

9. A support according to claim 8 wherein said attachment means includes a first pair of said mounting orifices alignable over said riser holes to secure said mount in an elevated position to accommodate one peep height, and a second pair of said mounting orifices alignable over said riser holes to secure said mount in a lowered position to accommodate a smaller peep height.

10. Apparatus in combination with a bow riser for adjustably positioning an aiming sight relative to said riser, said apparatus comprising:

a mount connected to said riser;

a movable part connected to said mount, said movable part for carrying the aiming sight and being adjustable relative to said mount along an arcuate path corresponding to a first bow adjustment path about the archer's anchor point, said mount including attachment means for securing said mount to said riser, said attachment means being adjustable to allow tilting of said mount forwardly or rearwardly relative to said riser to shift said arcuate path correspondingly into a second bow adjustment path about the archer's anchor point, said second bow adjustment path corresponding to the archer's draw length; and support arms connected to said movable part for supporting the aiming sight within the archer's line of sight, one of said arms being adjustable relative to said movable part to shift the sight into a skewed position relative to said line of sight to compensate for the riser canter when the bow is drawn.

11. An apparatus according to claim 10 wherein said mount includes curved guide rails defining said arcuate path and said movable part includes curved channels for sliding along said guide rails as said movable part is adjusted along said arcuate path.

* * * * *